United States Patent [19]

Lenk et al.

[11] 3,971,372

[45] July 27, 1976

[54] OXYGEN-GENERATING APPARATUS FOR SCUBA DIVING

[76] Inventors: Ronald J. Lenk, 8919 Eldora Drive; David T. Fletcher, 3773 Belfast St., both of Cincinnati, Ohio 45236

[22] Filed: May 29, 1975

[21] Appl. No.: 581,716

[52] U.S. Cl. ..... 128/142 R; 128/191 R; 204/212; 204/129; 204/199

[51] Int. Cl.[2] ..... A62B 7/00

[58] Field of Search ..... 128/142–142.3, 128/140 R, 191 R, 190 R; 204/212, 213, 214, 129, 199

[56] References Cited

UNITED STATES PATENTS 3,504,669 4/1970 Albert ..... 128/142

3,616,436 10/1971 Haas ..... 204/129

*Primary Examiner*—Robert W. Michell
*Assistant Examiner*—Henry J. Recla
*Attorney, Agent, or Firm*—Irwin P. Garfinkle

[57] ABSTRACT

Oxygen generation by means of electrolysis is used for underwater swimming. The apparatus includes a backpack containing an oxygen generator, a battery, a storage tank and a purifier, plus breathing equipment, including hoses and mask. The generator comprises a cylindrical housing in which an electrolytic cell is rotatably mounted in such a manner that its center of gravity always maintains the electrode of the electrolytic cell in a vertical attitude irrespective of the pitch or diving position of the swimmer in the water.

11 Claims, 4 Drawing Figures

OXYGEN-GENERATING APPARATUS FOR SCUBA DIVING

BACKGROUND OF THE INVENTION

Scuba diving, as it is generally practiced today, utilizes one or more tanks of compressed oxygen which are strapped to the back of the swimmer. These systems require heavy, bulky equipment which make mobility difficult both in and out of the water. This invention eliminates the use of large storage tanks and uses an electrolytic oxygen generator.

The principles of electrolysis for oxygen generation have long been known. Electrolysis involves the splitting of compounds, such as water, into ionic-charged components of hydrogen and hydroxyl parts. These ions carrying, respectively. positive and negative charges, are known as cations and anions. The cations and anions are induced to migrate in an electrolytic cell under the influence of an electric potential impressed between an anode and a cathode so that the negative ions (the anions) are attracted to the anode and the positive ions (the cations) are attracted to the cathode. In order to provide a high concentration of ions of a low electrical resistance the electrolyte comprises a solution of water and sulfuric acid. In lieu of sulfuric acid, other electrolytes, such as sodium hydroxide or potassium hydroxide, are also used.

Prior efforts have been made in the past to generate oxygen by electroylsis for underwater swimming. For example, U.S. Pat. No. 3,504,669 to Albert uses a vest-type apparatus in which electrodes are spaced. But this system does not take into account the effect of body attitude, i.e., it makes no provision for supplying oxygen to the mask when the swimmer is diving.

Other patents showing the use of electrolysis for generating oxygen are shown in U.S. Pat. Nos. 3,119,759, 3,616,436, 3,565,068, 3,674,022, 2,984,607, 3,216,919 and 3,725,236.

SUMMARY OF THE INVENTION

This invention provides an electrolytic system of oxygen generation which is useful in scuba diving applications and which is capable of supplying oxygen irrespective of body pitch position when diving. The apparatus is sufficiently lightweight and compact so that it can be mounted on a swimmer's back and carried in a conventional manner. Means are also provided for momentarily blocking the breathing apparatus when the swimmer rolls.

As in conventional electrolytic systems, the apparatus uses spaced electrodes consisting of an anode and a cathode connected to the appropriate terminals of a battery and immersed in an electrolytic solution of sulfuric acid. In accordance with the invention, the electrolyte is contained in a rotatable cell mounted within a fixed cylinder. Connections to the cell are made through slip connections so that the cell is free to rotate on its pitch axis within the cylinder under the effect of gravity and thereby maintain a vertical orientation for efficient and continuous operation. Automatically operated valves are provided for temporarily blocking the oxygen hoses when the swimmer rolls in the water.

DESCRIPTION OF THE DRAWINGS

FIG. 3 is a cross-sectional view of the electrolytic cell used in accordance with this invention.

DESCRIPTION OF THE ILLUSTRATED EMBODIMENT

Figure 1:
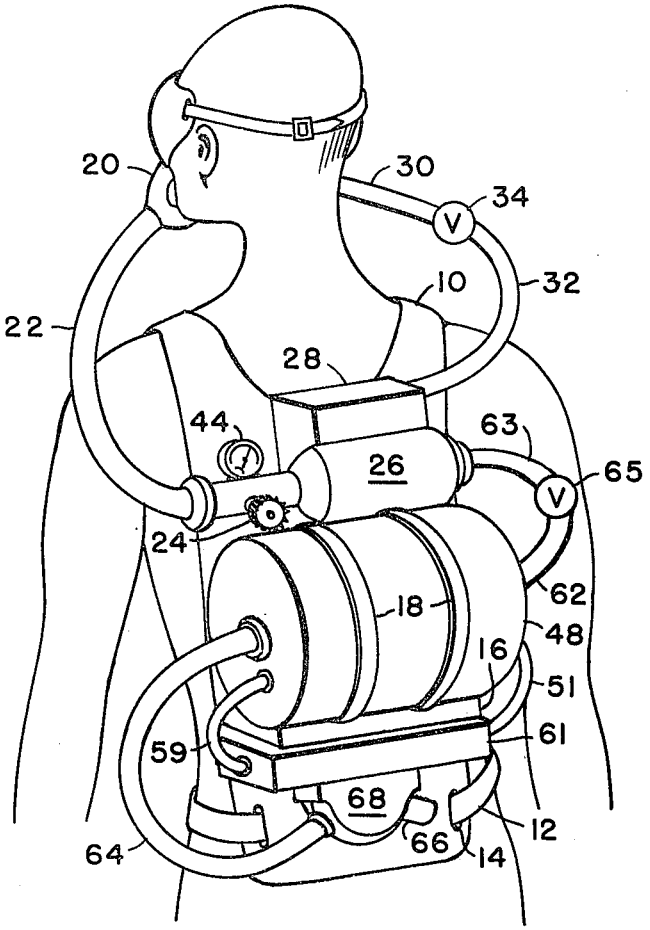
FIG. 1 is an illustration showing the overall breathing apparatus strapped to the back of a swimmer.

The general arrangement of the apparatus is shown in FIG. 1 in which the breathing apparatus is depicted strapped to the back of a swimmer. The apparatus includes a harness 10 worn as a shirt over the swimmer's shoulders and fastened fore and aft by means of a strap 12 laced through slots 14. The breathing apparatus is secured to the harness by conventional support members, including a support 16 and tank straps 18.

Figure 2:
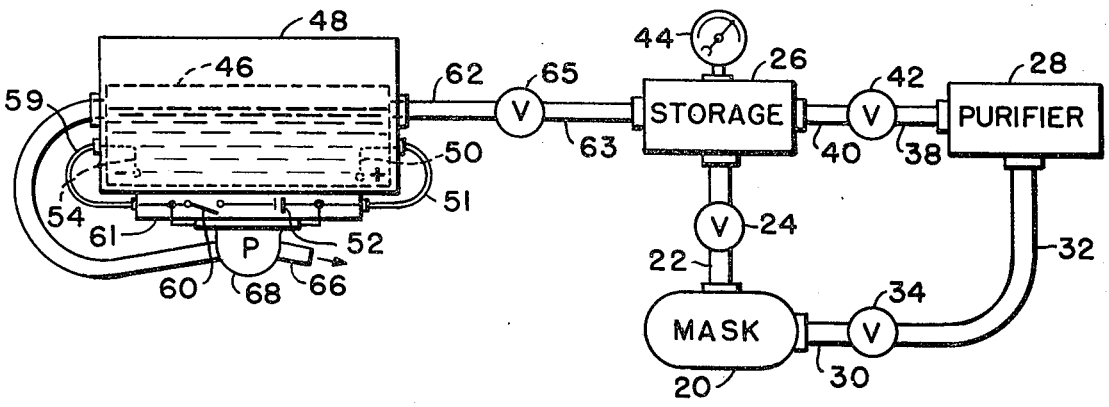
FIG. 2 is a schematic representation of the overall system.

As seen in FIGS. 1 and 2, the breathing apparatus includes a face mask 20 to which oxygen is supplied through a flexible hose 22 and a demand supply valve 24. The apparatus includes an oxygen storage tank 26 from which the oxygen is supplied to the swimmer as he inhales, and a conventional rebreather or purifier 28 which purifies the unconsumed exhaled oxygen. The partially consumed exhaled oxygen is supplied to the purifier 28 through flexible hose 30 and 32 and one-way valve 34. Oxygen from the purifier 28 is returned to the storage tank 26 through flexible hose 38 and 40 and a one-way valve 42. A meter 44 displays the pressure of the oxygen in the storage tank 26.

The oxygen generator, as illustrated in FIG. 2, comprises an electrolytic tank 46 rotatably mounted on its pitch axis in a cylindrical housing 48. As used in this application the pitch axis is defined as the horizontal axis of the tank when the swimmer is standing in a vertical upright position. A roll axis is an imaginary horizontal axis perpendicular to the pitch axis.

The tank 46 contains two electrodes, an anode 50 connected via insulated wiring 51 to the positive side of a battery 52, and a cathode 54 connected to the negative side via insulated wiring 59 and a switch 60. The battery 52 and switch 60 are housed in a waterproof insulating casing 61.

With a sulfuric acid electrolyte in the tank, and with the switch 60 closed, oxygen is formed at the anode 50 and passes through hoses 62 and 63 and a one-way valve 65 to the storage tank 26. In addition, hydrogen is formed at the cathode 54 and is pumped into the environment via hoses 64 and 66 by means of a motor-operated pump 68 energized from the battery 52.

Figures 4, 5:
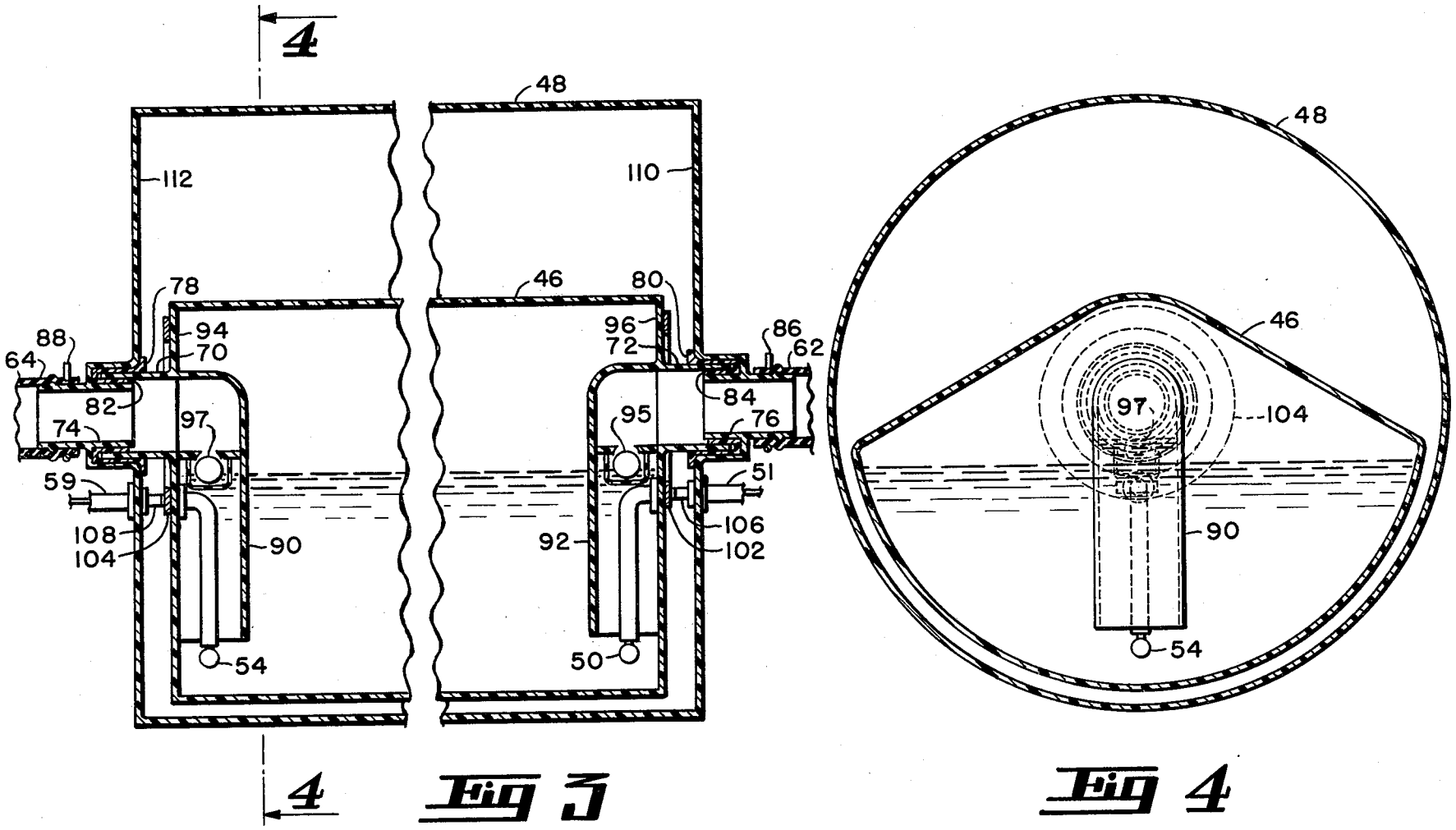
FIG. 4 is a section taken through the line 4-4 of FIG. 3.

The details of the electrolytic generator are shown in FIGS. 3 and 4. The tank 46 is formed of a rigid noncorrosive material and, as seen in FIG. 4, has a cross-section which comprises a portion of a cylinder just slightly smaller in diameter than the diameter of the cylindrical housing 48. The tank 46 has integral projecting shafts 70 and 72 which are rotatably supported within annular slots formed in projections 74 and 76. Plastic sleeve bearings 78 and 80, and 82 and 84, provide a bearing support and seals for the shafts 70 and 72, respectively. The hose 62 is clamped to the projection 76 by a spring clamp 86 while hose 64 is clamped to the projection 74 by a spring clamp 88.

Gas conduits 90 and 92 are formed on the interior of the cells 46 to provide passageways for the hydrogen and oxygen gases, respectively. The conduits 90 and 92 are essentially extensions of hollow shafts 70 and 72 formed on the inner side walls 94 and 96 of the cell.

The conduit 90 has a caged ball float valve 97 while the conduit 92 has a caged ball float valve 95. The valves 95 and 97 serve to close the respective conduits whenever the cell is rotated on its roll axis. As shown in the drawings, the valve 95 will float up to a closed position to close the conduit 92 when the cell rotates clockwise by an amount which would otherwise be sufficient to admit fluid to the hose 62. The valve 97 similarly protects the hose 64 when the cell rotates counterclockwise.

An anode 50 is mounted from within the conduit 92, while a cathode 54 is mounted from within the conduit 90. An electrical connection to the anode 50 is made through the wall 96 to a conducting ring 102 secured thereon. A similar connection is made from the cathode 54 to a conducting ring 104. Brushes 106 and 108 supported from the side walls 110 and 112 of the housing 48 are positioned against the rings 102 and 104, respectively. The brushes 106 and 108 are connected to the positive and negative sides, respectively, of the battery through leads 51 and 59.

In operation, the electrolytic cell 46 is initially filled with an electrolytic solution of fresh water and sulfuric acid. Sufficient electrolyte is used to cover the electrodes 50 and 54 but not so much that the liquid can enter the hoses 62 and 64. When the axis of the cell is horizontal, as noted before, the valves 95 and 97 prevent the electrolyte from entering the hoses 62 and 64 when the swimmer rolls.

When the switch 60 is closed a positive potential is applied to the anode 50 and a negative potential is applied to the cathode 54. In addition, the motor for the hydrogen pump 68 is energized. Hydrogen ions are attracted to the cathode 54 where a hydrogen gas is formed. The hydrogen gas rises through the conduit 90 to the level of shaft 70 from where it is then pumped out of the system by means of the pump 68. Similarly, hydroxyl ions are attracted to the anode 50 where oxygen gas is formed, rising through the conduit 92 to the surface of the electrolyte and then through the shaft 72 and hose 62 to the storage tank 26.

The center of gravity of the rotatable cell 46 is such that the electrodes 50 and 54 within the cell are maintained in a vertical orientation as the swimmer's body attitude rotates on the horizontal axis of the cell 46, thereby giving the swimmer freedom to dive and ascend without the electrolyte entering the hoses 62 and 64. When the axis of the cell 46 is not horizontal, as when the swimmer rolls when his body is in a horizontal position, the float valves 95 and 97 close the conduits. This is not a serious problem since there will generally be some reserve oxygen in the tank 26, and since the swimmer will simply take care not to maintain his body in such a roll position for an extended period of time. Normally, a swimmer would be in such a position only momentarily.

The illustrated embodiment is intended to be exemplary of the invention and many variations of within the scope thereof. For example, the cell 46 may be a full cylinder provided its center of gravity is below its axis of rotation. This may be accomplished by means of weights at the appropriate location on the cell. Furthermore, bearing and sleeve arrangements different from the simple arrangement shown may be substituted and indeed may be preferred. In addition, depending on system requirements, the pump 68 may not be needed, and if additional pressurization of the storage tank 26 is desired an oxygen pump may be used in the line 38 or 40.

We claim:

1. Underwater oxygen-generating apparatus for supplying oxygen for an underwater swimmer, said apparatus including an electrolytic oxygen generator adapted to be carried by the swimmer, said generator comprising:

a closed insulated container for containing an electrolytic solution;

mounting means for rotatably mounting said container for rotation on a normally horizontal axis, the center of gravity of said container being radially spaced from said axis, whereby said container rotates as said mounting means rotates on said horizontal axis;

a first anode electrode and a second cathode electrode mounted in said container and spaced from each other, said electrodes being oriented radially in the direction of said center of gravity, whereby said electrodes are normally maintained in a vertical orientation as said mounting means is rotated on said horizontal axis and wherein hydrogen gas forms at said cathode electrode and oxygen gas forms at said anode electrode;

means for connecting a two-terminal source across said electrodes; means for electrical insulating said connecting means from the surrounding environment; and a collector means at each electrode for collecting the gases generated thereat and for exiting the gases from said generator.

2. The invention as defined in claim 1 wherein said mounting means is a closed cylindrical housing, said horizontal axis being coaxial with the axis of said housing.

3. The invention as defined in claim 2 and first and second spaced axial outlets from said housing, said outlets communicating with said collectors.

4. The invention as defined in claim 1 wherein said support means comprises a closed cylindrical housing having first and second axially spaced end walls, said container having first and second hollow shafts journaled in said first and second end walls.

5. The invention as defined in claim 4 wherein said hollow shafts communicate with a respective collector, whereby gases in said collectors exit from said container through a respective hollow shaft.

6. The invention as defined in claim 5, and an oxygen breathing mask, means supplying oxygen exiting through one of said shafts to said mask.

7. The invention as defined in claim 5 and an oxygen storage tank, an oxygen breathing mask and an oxygen purifier, means supplying the oxygen exiting through one of said shafts to said storage tank, means supplying oxygen from said tank to said mask, and means returning exhaled oxygen from said mask to said tank through said purifier.

8. The invention as defined in claim 7 and an electric motor-operated pump for pumping hydrogen gas from the other of said hollow shafts.

9. The invention as defined in claim 5 wherein said container is a portion of a cylinder, said container being rotatable on the axis of said cylinder, said electrolytic solution filling said container to a level no higher than below said hollow shafts.

10. The invention as defined in claim 9 wherein said collectors are conduits leading from said hollow shaft and surrounding a respective electrode.

11. The invention as defined in claim 10 and valve means for preventing the flow of electrolytic solution through said hollow shafts.

* * * * *